US005088396A

United States Patent [19]

Thomas

[11] Patent Number: 5,088,396

[45] Date of Patent: Feb. 18, 1992

[54] TRASH COMPACTOR APPARATUS AND METHOD

[76] Inventor: Kenneth D. Thomas, 892 Summit, #214, Round Rock, Tex. 78664

[21] Appl. No.: 637,345

[22] Filed: Jan. 4, 1991

Related U.S. Application Data

[62] Division of Ser. No. 380,112, Jul. 14, 1989, Pat. No. 5,025,719.

[51] Int. Cl.[5] ..... B30B 13/00

[52] U.S. Cl. ..... 100/35; 100/99; 100/226; 100/229 A

[58] Field of Search ..... 100/35, 41, 99, 226-228, 100/229 R, 229 A, 240, 245-247, 252, 255, 281, 287, 294

[56] References Cited

U.S. PATENT DOCUMENTS

| | | | |
|---|---|---|---|
| 1,829,230 | 10/1931 | Meer | 100/35 |
| 2,465,839 | 3/1949 | Bloomfield | 100/226 X |
| 3,353,478 | 11/1967 | Hopkins | 100/229 A X |
| 3,357,346 | 12/1967 | Crafoord | 100/226 |
| 3,768,398 | 10/1973 | Ullman, Jr. | 100/246 X |
| 3,842,729 | 10/1974 | Mandrup | 100/229 A |
| 3,863,561 | 2/1975 | Karls | 100/226 X |
| 3,929,060 | 12/1975 | Burke | 100/229 R X |
| 4,658,720 | 4/1987 | Massonnet | 100/226 |
| 4,781,111 | 11/1988 | Chesnut | 100/99 |

FOREIGN PATENT DOCUMENTS

| | | | |
|---|---|---|---|
| 2003483 | 8/1971 | Fed. Rep. of Germany | 100/226 |
| 2912851 | 10/1980 | Fed. Rep. of Germany | 100/226 |

*Primary Examiner*—Harvey C. Hornsby
*Assistant Examiner*—Stephen F. Gerrity
*Attorney, Agent, or Firm*—Shaffer & Culbertson

[57] ABSTRACT

A trash compactor includes a receptacle with a receptacle opening, a closure member, and a collapsible compacting mechanism mounted in the closure member. The closure member is adapted to be secured over the receptacle opening in a compacting position. With the closure member in the compacting position, the compacting mechanism is adapted to be operated, preferably driven by an electric drive motor, so as to extend a compacting head into the receptacle through the receptacle opening to compact trash received therein. The compacting mechanism is also adapted to retract the compacting head substantially from the trash receptacle. A drive motor control system controls the operation of the drive motor in driving the compacting mechanism. Once the compacting head is retracted from the receptacle the closure member is adapted to be released from the compacting position thereby exposing the receptacle opening so that more trash may be deposited into the receptacle for compacting. The trash compacted also includes an indicator light display adapted to indicate the position of the compacting head in the receptacle.

9 Claims, 4 Drawing Sheets

TRASH COMPACTOR APPARATUS AND METHOD

This application is a division of application Ser. No. 07/380,112, filed on July 14, 1989 (now U.S. Pat. No. 5,025,719).

BACKGROUND OF THE INVENTION

The invention relates to trash or litter compactors, and more particularly, to a trash compactor apparatus and method adapted for efficient use of space. The trash compactor apparatus and method of the invention are therefore suitable for compacting applications in which the space available for compacting is limited, such as in automobiles for example.

Trash compactors are appliances used to compact trash or litter as it is collected. Trash compactors include generally a trash receptacle in which trash may be deposited and a compacting mechanism that is adapted to extend a compacting head into the receptacle periodically in order to compact the trash in the receptacle. Compacting trash as it is collected makes efficient use of trash receptacle space and thus generally reduces the size of trash receptacle required for a particular application. The efficient use of trash receptacle space also allows the receptacle to be emptied less frequently.

U.S. Pat. No. 3,842,729 to Mandrup illustrates a trash or refuse compactor adapted particularly for household use. The Mandrup compactor may advantageously be incorporated into a kitchen counter as a built-in to save kitchen space and includes a housing that houses a lower trash receptacle and a compacting mechanism mounted above the receptacle. The receptacle is adapted to be pulled out of the housing similar to a cabinet drawer to provide access for depositing trash into the receptacle. The compacting mechanism includes a scissor jack or pantographic linkages driven by a drive screw to alternatively extend or retract a compacting head. With the receptacle drawer closed so that the receptacle is positioned directly below the compacting mechanism, the compacting mechanism is adapted to extend the compacting head downward into the receptacle to compact the trash or refuse deposited therein. After compaction, the compacting mechanism retracts the compacting head from the receptacle so that the receptacle drawer may be opened and more trash deposited.

The trash or refuse compactor taught by Mandrup is well suited for household use since it may conveniently and attractively be incorporated into a kitchen counter similarly to other built-in appliances such as dishwashers. However, the Mandrup compactor requires a good deal of space because the compacting mechanism is positioned above the receptacle drawer and the entire receptacle must be pulled out in order to deposit trash therein. The space required makes the Mandrup compactor ill suited for many applications in which the space available for a compactor is restricted or limited, such as applications in automobiles for example.

U.S. Pat. No. 3,929,060 to Burke illustrates a trash or litter compactor specifically adapted for use in vehicles. The Burke compactor includes an elongated casing having a removable end portion and a side opening near the end opposite the removable end portion. A hand operated piston is slideably mounted in the casing on a compactor rod and adapted to be extended into the removable end portion for compacting trash, deposited into the casing through the side opening, into the removable end portion.

Although the Burke trash or litter compactor could be horizontally disposed and could therefore be adapted for use in a vehicle, the compactor was hand powered. Also, in order to deposit trash into the casing for compacting, the piston had to be withdraw substantially to the front end of the elongated casing with the compacting rod extending a substantial distance from the front of the elongated casing into the vehicle passenger compartment. Also, since trash had to be deposited into the casing through a side opening, the front end of the casing itself had to extend substantially into the passenger compartment.

SUMMARY OF THE INVENTION

It is generally an object of the invention to provide a trash compactor that overcomes the above mentioned problems associated with trash compactors.

Particularly, it is an object of the invention to provide a motor driven trash compactor apparatus that requires minimal space for installation and operation.

Another object of the invention is to provide a method for compacting trash while utilizing minimal space.

In order to accomplish these objectives, a trash compactor includes a collapsible compacting mechanism mounted in a lid or closure member. The closure member is adapted to be secured over an opening of a trash receptacle and to compact trash deposited in the receptacle through the receptacle opening. By compacting trash in the receptacle with a compacting mechanism mounted in the receptacle closure member, the trash compactor may be generally elongated in shape and may be disposed in a particular application so as to conserve space in one dimension. For example, a trash compactor according to the invention may be disposed substantially horizontally in or under the dashboard of an automobile. Since the elongated compactor is disposed horizontally, it takes up relatively little vertical space and thus does not substantially interfere with the leg room in the vehicle and may be adapted so as not to extend substantially from the dashboard.

One preferred trash compactor embodying the principles of the invention includes a compactor housing with a front opening and a receptacle adapted to be received in the housing through the housing front opening. ; The receptacle includes a receptacle opening adapted to generally align with the housing opening when the receptacle is properly received therein. A closure member is adapted to be secured to the housing so as to cover the receptacle opening and a collapsible compacting mechanism including a compacting head is mounted in the closure member. With the closure member secured over the receptacle opening, the compacting mechanism is adapted for extending the compacting head into the receptacle through the receptacle opening in order to compact trash received in the receptacle and then for retracting the compacting head so that the closure member may be removed and more trash deposited into the receptacle for compacting. A suitable motor, preferably connected to the housing, provides the power to drive the compacting mechanism through a drive linkage mounted in the housing and in the closure member.

In one preferred form of the invention, the housing is elongated and has a generally rectangular transverse cross sectional shape with the housing opening at one end thereof. The preferred receptacle is also elongated, open at one end, and has generally a rectangular cross section. The housing includes a track, preferably with a number of rollers, for receiving the receptacle through the housing opening and guiding the receptacle to a position with the receptacle opening generally aligned with the housing opening and the closed opposite end of the receptacle firmly against one or more stop members in the housing. Also, the receptacle is adapted to be lined with a suitable liner bag which may be removed easily to dispose of the trash received in the receptacle. The liner bag preferably includes strips of crimpable material extending its entire length, the strips being adapted to be crimped so as to seal the open end of the bag when the bag is full. In the preferred method of the invention, the strips are adapted to be crimped and the liner bag sealed by the action of the compacting head as it extends into the compactor housing.

The closure member is preferably hinged to the housing with a suitable hinge or pivot means and adapted to pivot from a closed or compacting position covering the housing and the receptacle opening to an open position with the receptacle opening exposed. A suitable locking mechanism is included in the closure member for securely locking the closure member to the compactor housing in the closed position.

The preferred compacting mechanism is mounted within the closure member and includes a scissor jack mechanism adapted to be extended into and retracted from the receptacle by the rotation of an elongated drive screw when the closure member is in the closed or compacting position covering the receptacle opening. The drive screw is mounted for rotation about its longitudinal axis and is connected to the scissor jack members or linkages through suitable trunnions, each having a threaded opening adapted to drivingly receive the drive screw. At the ends of the jack members or linkages opposite the drive screw, the linkages are pivotally connected to the compacting head which is shaped to fit snugly within the preferred bag-lined receptacle.

In operation, with the closure member secured in the closed or compacting position, the drive screw is rotated about its longitudinal axis. The drive screw drives the trunnions by their respective threaded openings so that the trunnions converge toward the center of the drive screw. As the trunnions in the preferred form of the invention converge, the scissor jack members extend thereby extending the compacting head into the bag-lined receptacle so as to compact trash received therein. When the drive screw is rotated in the opposite direction, the trunnions diverge thereby retracting the jack members or linkages and the compacting head, leaving the compacted trash at the end of the receptacle opposite the open end. When the compacting head is fully retracted back into the closure member, the closure member may be unlatched and moved to its open position exposing the receptacle opening so that more trash may be deposited into the receptacle.

In the preferred form of the invention, the drive motor is a suitable electric motor and is mounted to the housing at the end opposite the housing opening. When the compactor is adapted for use in a vehicle, the motor is preferably adapted to operate on current from the vehicle's electrical system, 12 volt direct current for example.

The drive linkage connects the drive motor and the drive screw for enabling the motor to rotate the drive screw about its longitudinal axis. In the preferred form of the invention, the drive linkage includes a suitable drive screw gear mounted at each end of the drive screw, two releasable closure member linkages and two elongated extension shafts. The two elongated extension shafts are mounted for rotation about their longitudinal axes in the housing, each extension shaft extending from near the rear of the housing to near the housing opening. The preferred drive linkage also includes a series of gears mounted at the rear of the housing adapted to rotate both extension shafts about their longitudinal axes as the drive motor is operated. Each releasable closure member linkage is adapted to extend from one of the extension shafts in the housing to the closure member to drive the drive screw when the closure member is in the compacting position, and also to release to allow the closure member to pivot to its open position.

The compactor also preferably includes a drive motor control system for controlling the operation of the drive motor to compact trash in the receptacle. The motor control system provides power to the compactor motor to extend the compacting head into the receptacle and then to withdraw the compacting head once compaction is completed. The compacting head is withdrawn either after it encounters a certain resistance as it advances or after it is fully extended whichever condition is first encountered.

In one form of the invention, the trash compactor includes a display for indicating the space available in the receptacle each time the compacting head is extended into the receptacle. The preferred indicator display includes a series of suitable lights mounted on the closure member. An electrical slide board and slide are also mounted in the closure member. The slide is mounted on the of the trunnions, and is adapted to move alon9 the slide board as the compactor head extends into the receptacle to provide electrical signals to energize the lights in the display.

These and other objects, advantages and features of the invention will be apparent from the following description of the preferred embodiments, considered along with the accompanying drawings.

BRIEF DESCRIPTION OF THE DRAWINGS

FIG. 2 also illustrates preferred forms of the trash receptacle and receptacle liner according to the invention.

DESCRIPTION OF THE PREFERRED EMBODIMENTS

Figure 1:
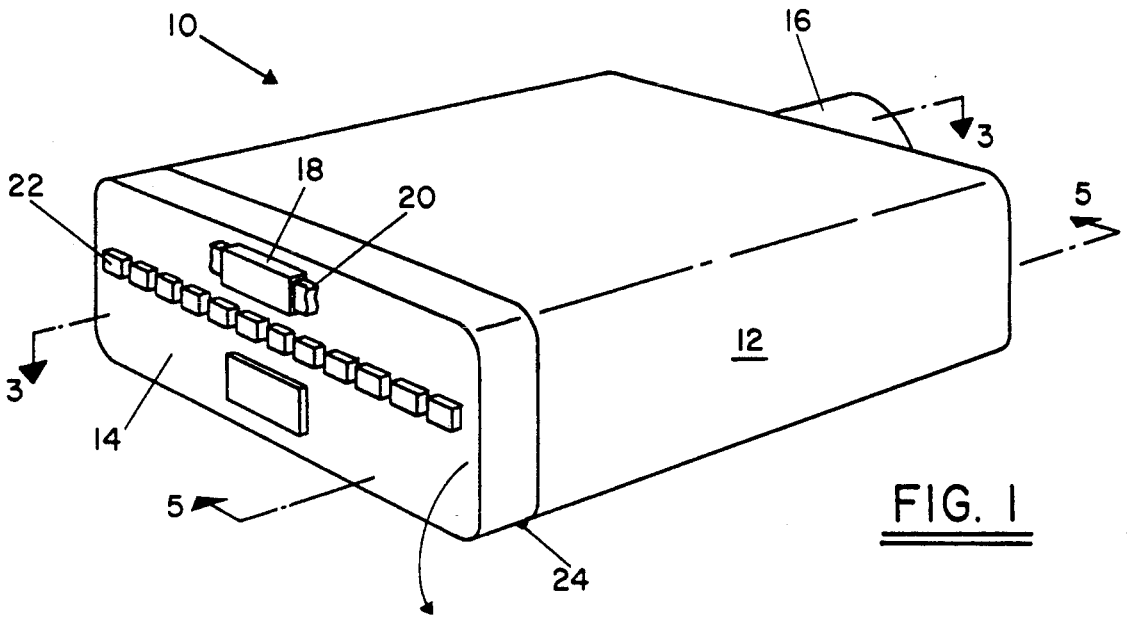
FIG. 1 is a view in perspective illustrating a trash compactor embodying the principles of the invention.

FIG. 1 illustrates a trash compactor embodying the principles of the invention indicated generally by reference number 10. The compactor 10 includes a housing 12, a closure member 14 shown connected to the housing in a closed or compacting position, and a drive motor 16 mounted at the end the housing opposite the closure member. The illustrated preferred closure member 14 includes an indicator display 22 and a locking mechanism indicated generally at 18 having a latch actuator 20.

Figure 2:
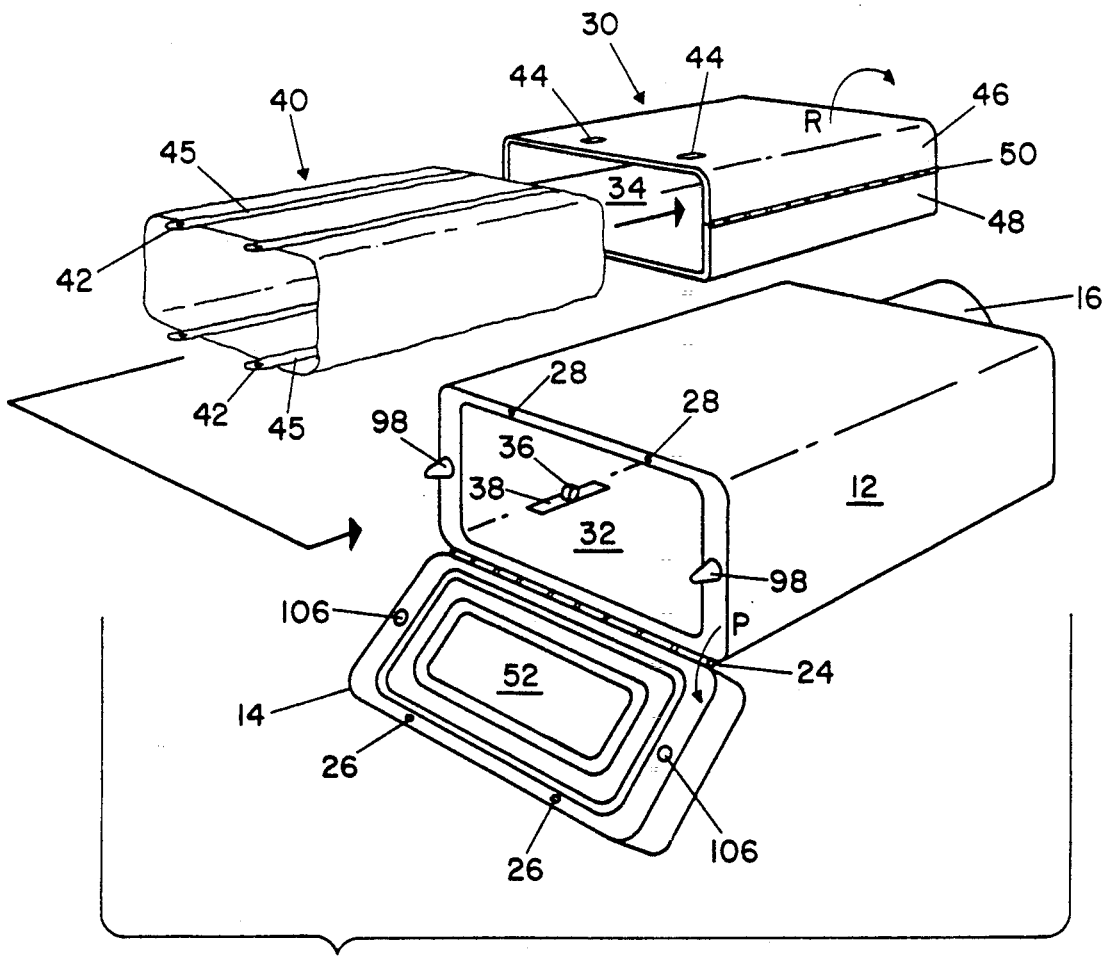
FIG. 2 is a view in perspective of the trash compactor of FIG. 1 with the closure member in the open position and the trash receptacle removed.

The closure member 14 is adapted to release from the compactor housing 12 and the compacting position shown in FIG. 1 to an open position, shown in FIG. 2, in which the interior of the housing is exposed. In the preferred form of the invention illustrated in FIG. 2, the closure member 14 is pivotally connected along one edge to the compactor housing with a suitable pivot connection or hinge 24 and is adapted to pivot from the closed compacting position to the open position as indicated by arrow P in FIG. 2. The preferred locking mechanism 18 includes a pair of latch members 26 operated by the latch actuator 20 (FIG. 1) mounted on the closure member, each being adapted to latch on a latch receptacle 28 in the housing 12 so as to retain the closure member 14 in the. closed or compacting position of FIG. 1. The latch members 26 are adapted to be unlatched from the latch receptacles 28 with the latch actuator 20 shown in FIG. 1.

The compactor housing 12 is adapted to receive a trash receptacle 30 in the interior of the housing through a housing opening 32. The receptacle 30 is elongated with a generally rectangular cross-sectional shape and an open end 34, and is adapted to be received into the housing so that the receptacle opening is generally aligned with the housing opening 32. The compactor housing 12 also preferably includes a plurality of rollers 36 adapted to help facilitate the insertion of the trash receptacle 30 into the compactor housing. The rollers are preferably biased toward the interior of the housing with a suitable biasing spring mount 38 so as to firmly contact the trash receptacle 30 inserted in the housing 12.

FIG. 2 also illustrates a preferred receptacle liner or bag 40 that is adapted to line the interior of the trash receptacle 30. The receptacle liner 40 is preferably disposable, being made of a suitable disposable material such as paper or plastic. The preferred liner 40 also includes a plurality of rings 42 adapted to cooperate with clasps 44 on the receptacle 30 for holding the liner in place in the receptacle. The preferred liner 40 further includes crimpable wire or plastic strips 45 for helping to seal the liner once full. Also, the preferred receptacle 30 includes an upper receptacle half 46 and a lower receptacle half 48 pivotally connected or hinged along one side by suitable receptacle pivot connector 50, the two receptacle halves being adapted to pivot apart about the pivot member in the direction indicated by arrows R in FIG. 2 to help facilitate removal of the liner 40 when full.

FIG. 2 also shows a compacting head 52 mounted in the closure member 14. The compacting head 52 is adapted to substantially align with the trash receptacle opening 34 when trash receptacle 30 is properly received in the housing 12 and the closure member 14 is secured to the housing in the closed or compacting position shown in FIG. 1. The compacting head 52 is adapted to be extended from the closure member 14, when the closure member is in the compacting position, into the trash receptacle 30 through the receptacle opening 34 to compact trash deposited in the receptacle. Such trash may be deposited in the trash receptacle when the closure member 14 is in the open position illustrated in FIG. 2.

Figure 3:
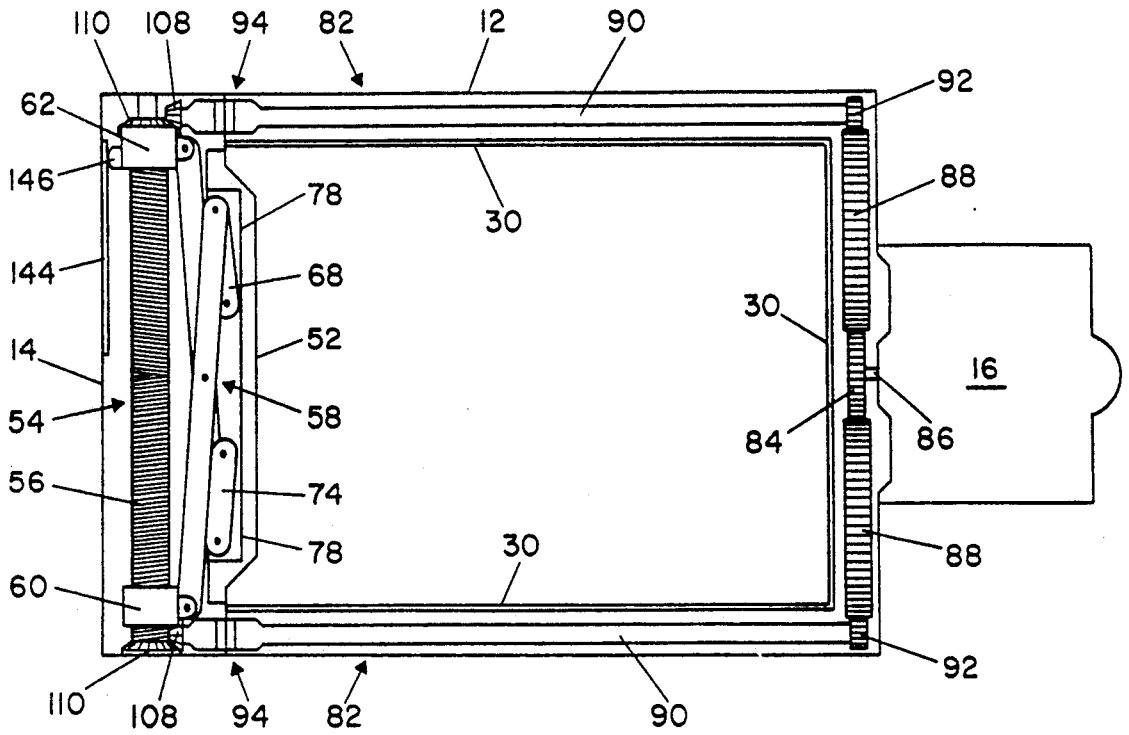
FIG. 3 is a view in longitudinal section taken along line 3—3 in FIG. 1 with the compactor head shown in the retracted position.
Figure 4:
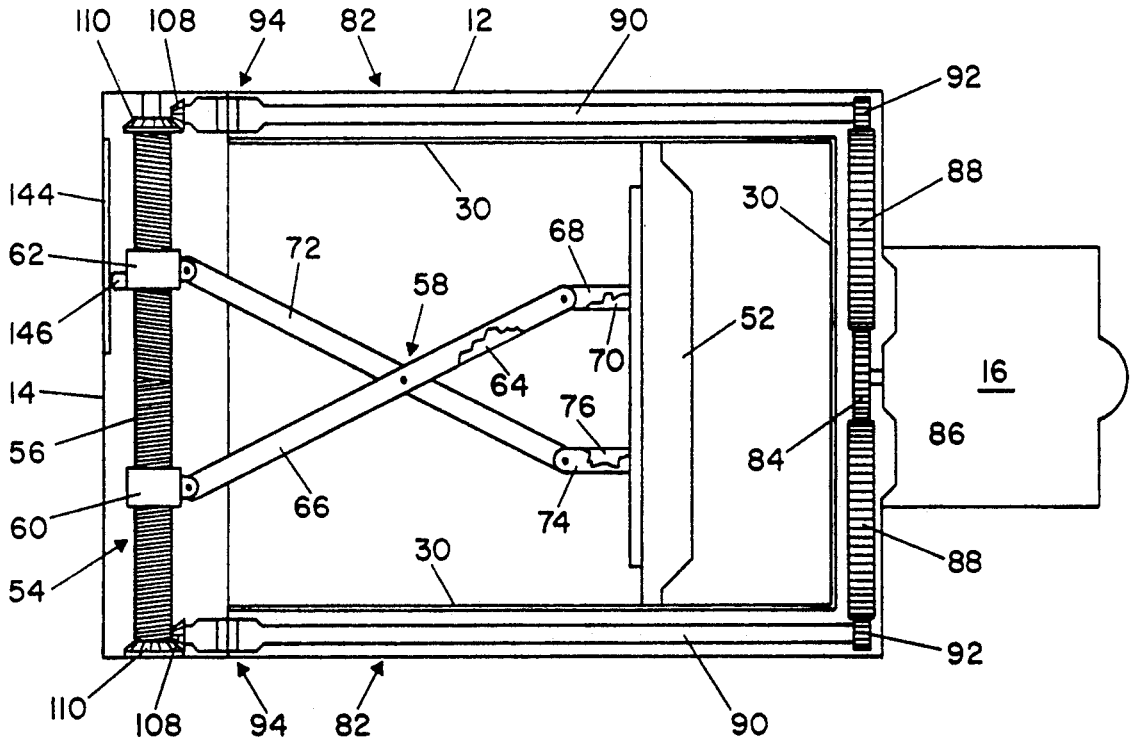
FIG. 4 is a view in longitudinal section similar to FIGURE 3 but showing the compactor head in an extended position, and partially cut away to show all of the scissor jack members.
Figure 5:
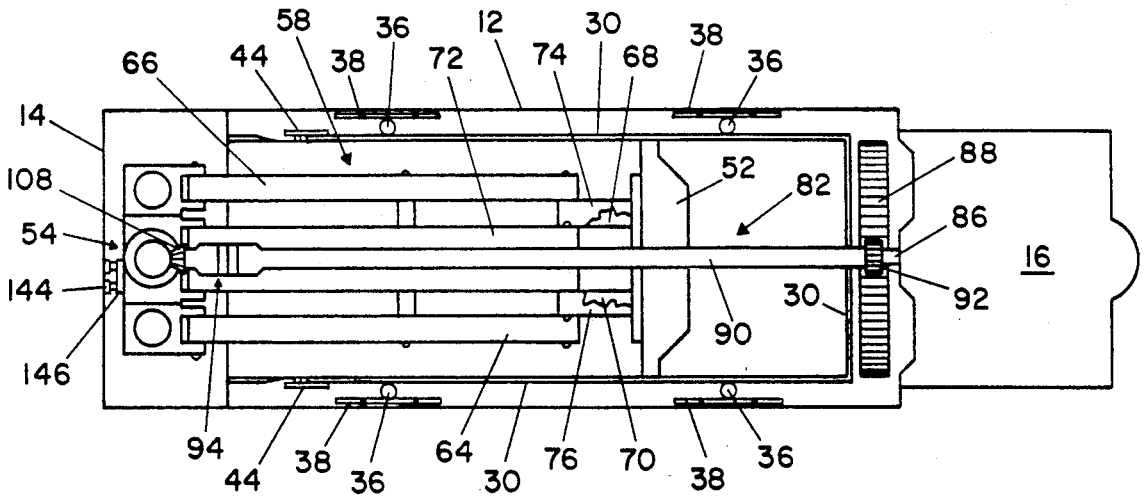
FIG. 5 is a view in longitudinal section taken along line 5—5 in FIG. 1 showing the compactor head in the extended position of FIG. 4, and partially cut away to show all of the scissor jack members.

Referring to FIGS. 3, 4, and 5 the compacting head 52 is part of a compacting mechanism, generally indicated by reference number 54, mounted in the closure member. The compacting mechanism also includes a drive screw 56 and a scissor jack 58 connected between the drive screw and the compactor head 52. The scissor jack 58 is connected to the drive screw 56 by two trunnions 60 and each having a threaded opening and being adapted to travel along the drive screw as the drive screw rotates about its longitudinal axis. In the preferred form of the invention, the scissor jack 58 includes major linkage members 64 and 66 each pivotally connected at one end to the trunnion 60 and pivotally connected at the other end to minor linkage members 68 and 70 which are pivotally connected to the compactor head, and a third major linkage 72 pivotally connected to the trunnion 62 and connected at the opposite end to minor linkage members 74 and 76 which are each pivotally connected to the compactor head 52. As shown in FIG. 3, the minor linkage members are each adapted to retract into a separate channel 78 in the compacting head 52. The channels 78 enable the scissor jack 58 to collapse into a very small area, with the compacting head 52 substantially retracted from the receptacle 30.

Figure 6:
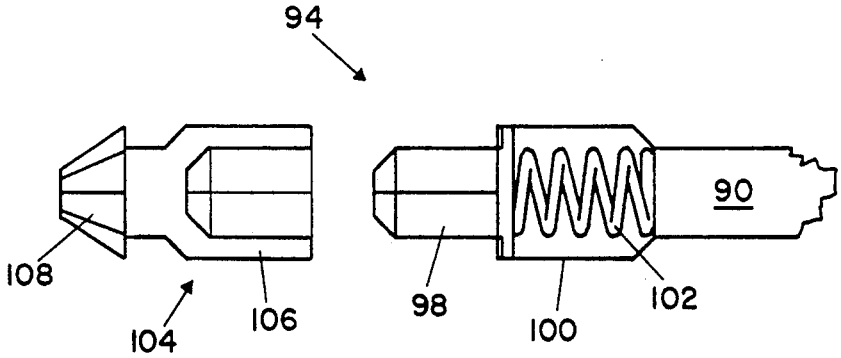
FIG. 6 is a view in section illustrating a preferred releasable drive linkage according to the invention.

As also illustrated in FIGS. 3, 4, and 5, the compactor 10 also includes drive linkage means 82 connected between the drive motor 16 and the drive screw 56 for enabling the drive motor to drive or rotate the drive screw about its longitudinal axis when the closure member 14 is connected to the compactor housing 12 in the closed or compacting position. The drive linkage means 82 includes a main gear 84 rigidly connected for rotation on the drive motor shaft 86 in position to drive two connecting gears 88. Each connecting gear 88 is adapted to drive an extension shaft 90 by an extension shaft gear 92. The extension shafts 90 are each mounted in the housing generally adjacent to the trash receptacle 30 for rotation about their longitudinal axes and extend substantially the length of the compactor housing 12. The linkage means 82 also includes a releasable drive linkage 94 for each extension shaft 90 adapted to extend between each said extension shaft 90 and the drive screw 56 for driving the drive screw. Each releasable drive linkage is adapted to easily release from the connected or driving position shown in FIGS. 3, 4, and 5, allowing the closure member to release from the compacting or closed position shown in 19 FIG. 1 to the open position of FIG. 2. FIG. 6 illustrates the preferred releasable drive linkage 94. Each releasable drive linkage 94 includes a plunger member 98 slideably mounted in a plunger casing 100 connected to the respective extension shaft 90 near the open end of the compactor housing 12. The plunger member 98 is biased in an extended position by a plunger member biasing spring 102. Each releasable drive linkage 94 also includes a closure member linkage 104 mounted for rotation in the closure member 14. Each closure member linkage 104 includes a receiver casing 106 and a suitable end gear 108. Each receiver casing 106 is adapted to receive the corresponding plunger member 98 when the closure member 14 is secured to the compactor housing 12 in the closed or compacting position shown in FIGS. 3, 4, and 5, and the end gear 108 is adapted to mesh with a suitable drive screw gear 110 to rotate the drive screw 56 in response to the rotation of the closure member linkages 104. The plunger member 98 and receiver casing 106 of each releasable drive linkage 94 are also illustrated in FIG. 2, the plunger member 98 biased so as to extend from the compactor housing 12 in position to be received in the corresponding receiver casing 106 when the closure member is closed.

Although the preferred form of the invention illustrated in the FIGURES includes a drive linkage means 82 having two separate extension shafts 90, a compactor pursuant to the invention may include only a single extension shaft and related gearing. Furthermore, the invention may include different types of gearing from the illustrated preferred types. For example the closure member linkage may mesh with the drive screw with a worm gear arrangement rather than with the illustrated tapered gear arrangement.

The operation of the trash compactor 10, according to the invention, may now be described with particular reference to FIGS. 2 through 5. With the trash receptacle 30, preferably lined with the receptacle liner 40, received in the compactor housing as shown in FIGS. 3, 4 and 5, trash to be compacted may be deposited into the lined receptacle through the receptacle opening 34 when the closure member 14 is pivoted to the open position shown in FIG. 2. Once the trash is deposited into the receptacle 30, the closure member 14 is pivoted to the closed or compacting position of FIGS. 1 and 3–5 and secured in such position by the latch members 26 and latch member receptacles 28 (FIG. 2). FIG. 3 best illustrates the trash compactor 10 with the closure member 14 having just been secured to the compactor housing in the compacting or closed position. In the compacting or closed position, the releasable drive linkages 94 are connected in position for driving the drive screw, each plunger member 98 being received in the corresponding plunger receiver casing 106 mounted in the closure member 14.

With the compacting head 52 and scissor jack 58 in the fully retracted position shown in FIG. 3, the drive motor 16 is operated to drive or rotate the drive screw 56 about its longitudinal axis through the drive linkage means 82. As the drive screw 56 is rotated, the trunnions 60 and 62 converge towards the center of the drive screw thereby extending the scissor jack 58 and the compacting head 52 into the trash receptacle 30. The fully extended position is shown in FIGS. 4 and 5. The compacting head 52 compacts trash received in the trash receptacle 30 as it extends into the trash receptacle. After the trash is compacted by the compacting head 52, the drive motor 16 is reversed to rotate the drive screw 56 about its longitudinal axis in the opposite direction causing the trunnions 60 and 62 to diverge along the drive screw, thereby retracting the scissor jack 58 and compacting head from the trash receptacle 30. Once the compacting head 52 and scissor jack 58 are completely retracted back to the position shown in FIG. 3, the closure member 14 may be released from the closed or compacting position using the latch actuator mechanism 20 shown in FIG. 1, and then pivoted to the open position shown in FIGURE 2 with the trash receptacle opening 34 exposed for receiving more trash to be compacted.

Once the lined trash receptacle 30 is full of compacted trash, the preferred method of the invention further includes removing the rings 42 from the clasps 44 and folding the open end of the liner 40 into the receptacle opening 34. The compactor head 52 may then be extended to further fold the open end of the bag 40 and to crimp the crimpable strips 45 so as to seal the liner bag. The compactor head 52 may then be retracted, the receptacle 30 removed from the housing and the receptacle liner 40 removed for disposal. In the preferred form of the invention shown in FIG. 2, the receptacle pivot member 50 is pivoted in the direction indicated by arrows R to help facilitate removal of the full receptacle liner 40.

Figure 7:
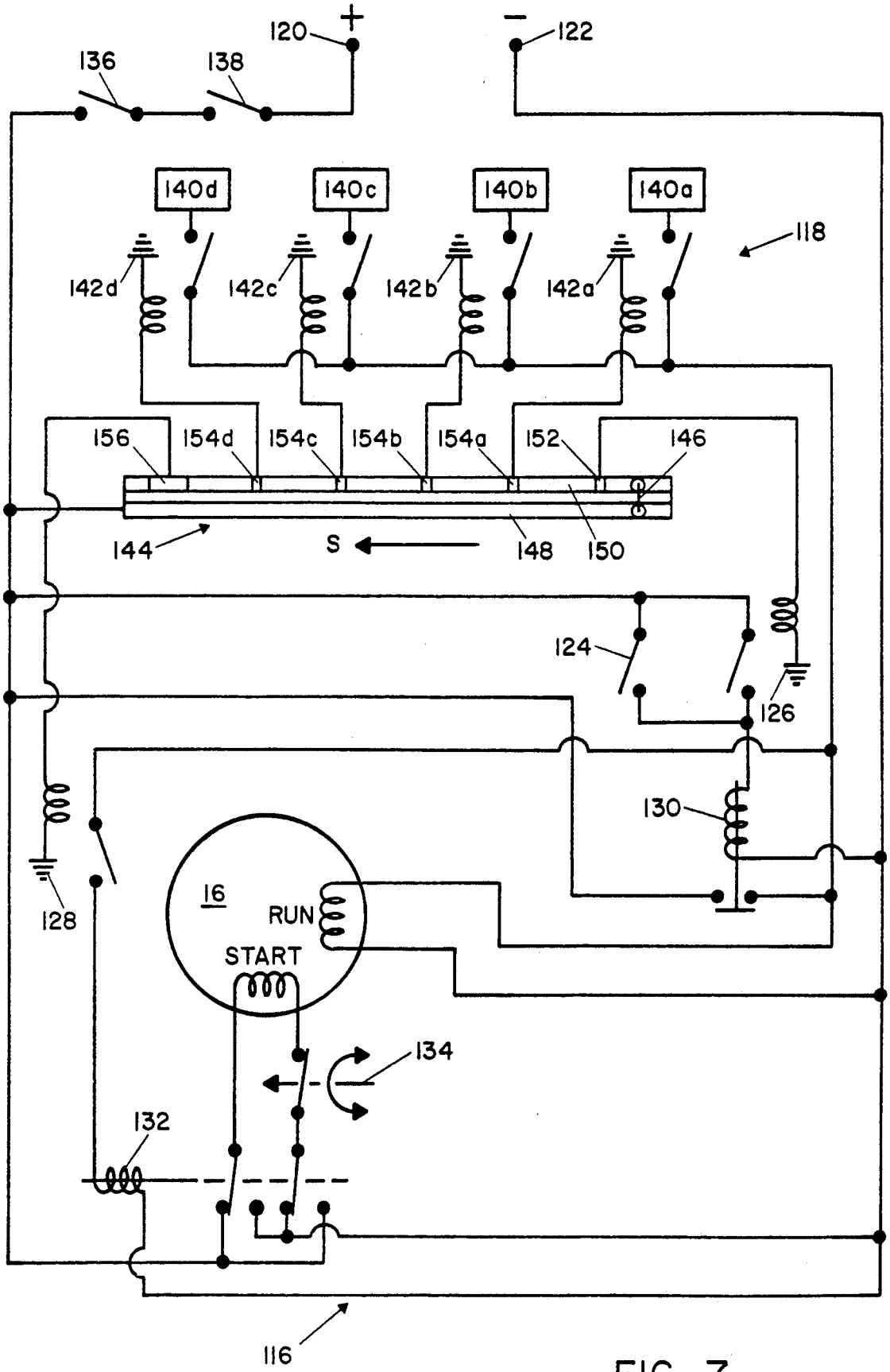
FIG. 7 is a schematic diagram showing a drive motor control system pursuant to the invention.

The preferred form of the invention also includes control means 116 illustrated in FIG. 7 for controlling the operation of the drive motor 16 and compactor display means 118 for indicating the position of the compacting head in the receptacle. In the form of the invention illustrated in FIGURE 7, the display means 118 is partially incorporated into the motor control means 116.

Referring to FIG. 7, the motor control 116 and display 118 are adapted to operate on direct current from the vehicle's electrical system connected to positive lead 120 and negative lead 122. The motor control 116 includes a momentary start switch 124, a top limit relay 126, a bottom limit relay 128, a main power relay 130, a reversing relay 132, and a centrifugal switch 134, all for controlling the drive motor 16. A door switch 136 and receptacle switch 138 prevent the compactor from operating when the door is unlatched or the receptacle is absent, respectively. The display means 118 includes a series of display lights 140*a–d* having a light energizing relay 142*a–d*, respectively. An electric slide board 144 and slide 146 cooperate to provide control signals not only to the light energizing relays 142*a–d* but also to the top limit switch 126 and bottom limit switch 128. The slide board 124 includes an elongated electrical contact strip 148 spaced slightly from a contact strip 150 having a top limit switch control terminal 152, light terminals 154*a–d*, and a bottom limit terminal 156. The slide 146 is connected to one of the trunnions (see FIG. 3 and 4) and is adapted to slide along the length of the slide board 144 straddling the gap between the contact strip 148 and terminal contact strip 150 to provide the desired control signals.

The operation of the preferred control system 116 and compactor display 118 can be described with reference to FIGURES 1, 2, and 7. Positioning a receptacle 30 (FIG. 1) in the compactor housing closes the receptacle switch 138, and closing the closure member 14 closes the door switch 136 to provide power for operating the drive motor 16. The motor 16 is started by momentarily closing the momentary start switch 124, the momentary start switch being conveniently located preferably on the front of the closure member 14. Closing the momentary start switch energizes and closes the main power relay to supply power to the primary power coil of the motor 16. As the motor 16 operates to extend the compacting head into the receptacle, the slide 146 connected to the trunnion slides along the slide board 144 in the direction indicated by arrow S. Once the slide passes the top limit relay terminal 152, the relay coil is energized and the contact of the top limit relay is closed to maintain the main power relay in the closed energized position. The top limit relay is adapted t remain closed until the slide 146 re-energizes the relay coil at which time the top limit relay is again opened. Thus, the top limit relay maintains the main power relay in the closed position as the slide 146 continues along the slide board 144 in the direction S.

As the slide 146 continues in direction S, it eventually passes the light terminals 154*a–d* energizing the light energizing relays 142*a–d*, respectively. Thus, the indicator lights 140*a–d* indicate the position of the compacting head in the receptacle. Although only four lights are shown in FIGS. 7 for purposes of description, more (as shown in FIG. 1) or even fewer lights could be used. Once the slide reaches the opposite end of the slide board 144 and bottom limit terminal 156, the bottom limit relay is energized to provide power to the reversing relay which reverses the polarity on the drive motor 16, thereby reversing the direction of operation and causing the compacting head to be withdrawn from the receptacle. As the compacting head is withdrawn, the slide 146 travels back along the slide board 144 in the direction opposite that indicated by arrow S until the top limit relay terminal is reached and passed, which again opens the top limit relay to open the main power relay and thereby stop the drive motor 16.

When the receptacle is partially full, the compacting head will not travel the entire length of the receptacle and thus the slide 146 will not travel the entire length of the slide board 144. To reverse the operation of the motor 16 when the receptacle is partially full, the centrifugal switch 134 is adapted to open as the drive motor 16 bogs down and can advance the compacting head no further into the receptacle. The opening of the centrifugal switch reverses the operation of the drive motor so that the motor retracts the compacting head.

The above described preferred embodiments are intended to illustrate the principles of the invention, but not to limit the scope of the invention. Various other embodiments and modification to these preferred embodiments may be made by those skilled in the art without departing from the scope of the following claims.

What is claimed is:

1. A method for compacting trash comprising the steps of:

A. placing rash to be compacted into a receptacle through an opening in the receptacle;

B. securing a closure member over the opening of the receptacle;

C. drivingly engaging a compacting mechanism with drive means mounted adjacent to the receptacle, the compacting mechanism being mounted on the closure member and the step of drivingly engaging the compacting mechanism being performed simultaneously with the step of securing the closure member over there opening of the receptacle;

D. extending a compacting head into the receptacle through the receptacle opening by driving the compacting mechanism with the drive means, the compacting head being connected to the compacting mechanism; and E. retracting the compacting head substantially from the receptacle through the receptacle opening by driving the compacting mechanism with the drive means.

2. The method of claim 1 including the step of releasing the closure member from its position over the receptacle opening after the compacting head is retracted from the receptacle, thereby exposing the receptacle opening for receiving trash.

3. The member of claim 1 wherein the step of securing the closure member over the receptacle opening includes latching the closure member to a compactor housing adjacent to the receptacle opening with latching means.

4. The method of claim 1 wherein the steps of securing the closure member and drivingly engaging the compacting mechanism include linking the drive means to the compacting mechanism with a drive linkage means.

5. The method of claim 1 including the step of providing an indication of the position of the compacting head in the receptacle as the compacting head is extended and retracted.

6. The method of claim 5 wherein the step of providing an indication of the position of the compacting head in the receptacle includes sequentially lighting a plurality of display lights as the compacting head is extended into the receptacle.

7. The method of claim 6 wherein the step of sequentially lighting a plurality of display lights as the compacting head is extended into the receptacle includes providing display light control signals through the movement of the compacting mechanism to sequentially light the display lights.

8. The method of claim 1 including the steps of:

A. lining the receptacle with a liner bag prior to placing trash in the receptacle, the liner having a plurality of crimpable strips extending the length thereof, and an open end aligning with the receptacle opening;

B. folding the open ends of the liner bag into the receptacle when the liner is full of trash; and C. extending the compacting head into the receptacle to further fold and crimp the crimpable strips on the liner bag to substantially seal the liner bag while still contained in the receptacle.

9. The method of claim 1 including the steps of:

A. lining the receptacle with a liner bag having a liner bag opening aligned with the receptacle opening; and B. connecting at least one liner connecting member connected to the liner bag near the liner opening to the receptacle near the receptacle opening in order to retain the liner bag opening in an aligned position with the receptacle opening.

* * * * *

UNITED STATES PATENT AND TRADEMARK OFFICE

CERTIFICATE OF CORRECTION

PATENT NO. : 5,088,396

DATED : February 18, 1992

INVENTOR(S) : Kenneth D. Thomas

It is certified that error appears in the above-identified patent and that said Letters Patent is hereby corrected as shown below:

In Claim 1, column 9, line 44 of the Patent, change "rash" to --trash--.

In Claim 3, column 10, line 12 of the Patent, change "member" to --method--.

In Claim 9, column 10, line 53 of the Patent, delete "connecting" before "member" and substitute --connector-- therefore.

Signed and Sealed this

Twenty-fifth Day of May, 1993

*Attest:*

Michael K. Kirk

MICHAEL K. KIRK

*Attesting Officer*

*Acting Commissioner of Patents and Trademarks*